US008550296B2

(12) United States Patent
Gerschwiler Steck et al.

(10) Patent No.: US 8,550,296 B2
(45) Date of Patent: Oct. 8, 2013

(54) PERSONAL HYGIENE STORAGE UNIT

(76) Inventors: Nancy J. Gerschwiler Steck, Califon, NJ (US); Paul K. Steck, Califon, NJ (US)

( * ) Notice: Subject to any disclaimer, the term of this patent is extended or adjusted under 35 U.S.C. 154(b) by 213 days.

(21) Appl. No.: 13/134,321

(22) Filed: Jun. 3, 2011

(65) Prior Publication Data

US 2012/0305588 A1 Dec. 6, 2012

(51) Int. Cl.
*B65H 1/00* (2006.01)

(52) U.S. Cl.
USPC ..... 221/283; 221/34

(58) Field of Classification Search
USPC ..... 221/34, 283; 248/691
See application file for complete search history.

(56) References Cited

U.S. PATENT DOCUMENTS

| | | | | |
|---|---|---|---|---|
| 2,685,365 | A | 8/1954 | Sieven | |
| 3,463,345 | A * | 8/1969 | Bockenstette | 220/826 |
| 3,837,595 | A | 9/1974 | Boone | |
| 4,106,616 | A | 8/1978 | Boone | |
| 4,106,617 | A | 8/1978 | Boone | |
| 4,235,333 | A | 11/1980 | Boone | |
| 4,427,159 | A | 1/1984 | Miller et al. | |
| 4,834,316 | A | 5/1989 | DeLorean | |
| 5,004,106 | A * | 4/1991 | Blumstock et al. | 220/554 |
| 5,860,527 | A * | 1/1999 | Frankenberg et al. | 206/509 |
| 5,897,074 | A | 4/1999 | Marino | |
| 6,164,442 | A * | 12/2000 | Stravitz | 221/45 |
| 6,446,808 | B1 * | 9/2002 | Paul et al. | 206/494 |
| 7,128,235 | B2 * | 10/2006 | Haddad et al. | 221/45 |
| 7,147,129 | B1 * | 12/2006 | Menefield | 221/283 |
| 7,481,395 | B2 | 1/2009 | Rogers | |
| D623,482 | S * | 9/2010 | Lam | D7/629 |
| 2008/0169411 | A1 * | 7/2008 | Quinn et al. | 248/691 |

* cited by examiner

*Primary Examiner* — Timothy Waggoner
(74) *Attorney, Agent, or Firm* — Kenneth P. Glynn, Esq.; Deidra M. Meagher, Esq.

(57) ABSTRACT

A personal hygiene storage unit that functions both as a hanging storage/dispensing unit and as a personal hygiene travel pack includes: (a) a hollow body with a bottom, upwardly projecting walls and an open top; (b) a back hatch top hingeably connected to the back wall of the bottom and having closing mechanism to fix the back hatch top in a closed position; (c) a front hatch top hingeably connected to the front wall of the bottom; and, (d) a pair of opposing elongated hanging hooks connected to at least one of the main housing, the back hatch top and the front hatch top, for attachment to a toilet paper roll rod and hinges for folding the hooks to create a compact travel pack.

20 Claims, 7 Drawing Sheets

PERSONAL HYGIENE STORAGE UNIT

BACKGROUND OF INVENTION a. Field of Invention

The invention relates generally to personal high gene storage units that may be useful into different modes-in the bathroom or "on the road". The present invention storage unit may be hung from toilet paper roll rod or the hanger hooks may be folded so as to transform the storage unit into a travel pack for a hand bag, suitcase, backpack or otherwise. When hung from a toilet paper roll rod, it has plural unique features, including a forward tilt for gravity feed of contents such as packaged individual tampons; a forward opening front hatch that clears a toilet paper roll and optional segmented compartments.

b. Description of Related Art

The following patents are representative of the field pertaining to the present invention:

U.S. Pat. No. 7,481,395 B2 to Rogers describes a bathroom accessory adapted to connect with a bathroom tissue roll trunnion and support a container of wipes is disclosed. The bathroom accessory may include first and second brackets connected with and extending upward from base. The first and second brackets can be adapted to connect with a tissue trunnion, and the base can be adapted to support a container of wipes thereon. Embodiments of the bathroom accessory can be configured structural features to provide a keyed engagement a wipe container to help ensure that a particular type of wipe container is used with the wipe container holder. Other embodiments include features that may help secure the wipe container in a particular position on the wipe container holder. Further, embodiments of the wipe container holder can also be used when toilet training an individual.

U.S. Pat. No. 7,128,235 B2 to Haddad et al. describes a dual arm caddy to be attached to the spindle of a wall mounted toilet paper holder for carrying disposable wet wipes. The upper portion of each arm is attached by hooking the spindle, and the lower, utility portion is attached to a container inclined from front to rear. A lid is rear-hinged. The hooking means can be a U-shaped slot open in the rear of the arm's upper portion, and inclined upward and elongated to assure the caddy makes wall contact before engaged spindle reaches slot's upper end. Embodiments include caddies suspendable from crossbars such as towel racks to provide consistently horizontal and stable utility platforms throughout a rage of crossbar-to-wall distances. The hooking means of the arms can also be rounded to allow them to freely rest on top of the crossbar and the caddy configured to always occupy the space closest to the wall to which the crossbar is attached.

U.S. Pat. No. 5,897,074 to Marino describes a dispenser for moist tissue roll and a slot in the housing for dispensing the tissue from the roll. The dispenser includes arms for hanging the dispenser far from a fixed element. The arms also effect a seal between housing sections forming the housing.

U.S. Pat. No. 4,834,316 to DeLorean describes, an auxiliary bathroom tissue dispenser incorporating structural provisions for a deodorizer and wet tissue dispenser. A pair of support brackets hook over a conventional pre-existing primary bathroom tissue roll trunnion. A container having a plurality of air passable openings connects with the support brackets for holding replaceable deodorant tablets. A platform located at the top of the container is structured for holding a conventional wet tissue dispenser. A pair of resilient dispenser brackets depend below the container for holding an auxiliary bathroom tissue roll via a nib on each dispenser bracket, the nibs mating with the center tube of the auxiliary bathroom tissue roll.

U.S. Pat. No. 4,427,159 to Miller et al. describes a holder for an extra roll of tissue in a wash room, so to be readily available in case the other roll of tissue is used up, the holder including a wire frame hung from the spindle of the conventional tissue roll holder, a second spindle supported on the frame, and a pivotable cover on the frame for hiding the spare tissue roll from view.

U.S. Pat. No. 4,235,333 to Boone describes a bathroom fixture of improved construction, function and appearance for making available both conventional toilet-tissue and a supplemental material, for example a moistening material for application to the human body such as premoistened sheets manually withdrawable from a container or housing component.

U.S. Pat. No. 4,106,617 to Boone describes a unitary multipurpose bathroom fixture of improved function and appearance for making available both conventional dry sheets of toilet-tissue from a roll carried by a spindle component and supplemental premoistened sheets from a container component. A first fastening means, exclusively serving an engaging purpose, is integral with portions supporting the spindle component. A second fastening means, also exclusively serving an engaging function, is integral with the container component. The two fastening means are adapted to effect a firm engagement with one another and thus to provide the unitary fixture. Also included are means for determining the direction of withdrawal of the premoistened sheets to insure their individual availability and to prevent dislodgment of the container. Other means relate to convenience and economy in supplying the premoistened sheets.

U.S. Pat. No. 4,106,616 to Boone describes a device readily attachable to a standard toilet-tissue dispenser of a roll type for positioning adjacent thereto in visual alignment supplemental material such as a container of pre-wetted toilet sheets. The sheets are manually withdrawable from an aperture, which is held firmly at a fixed position to assure their ready withdrawal and consistent location.

U.S. Pat. No. 3,837,595 to Boone describes a compact auxiliary device providing wetted or self-wetting sheets for releasable proximate mounting in conjunction with a conventional toilet-tissue dispenser of dry sheets; comprises an inexpensive container or magazine component pre-loaded with the supplemental sheets. The magazine can be snapped into functional position rapidly. It serves an improved health care and cleanliness function.

U.S. Pat. No. 2,685,365 to Sieven describes, in combination with a wrapped toilet tissue roll, means for supporting said roll as a replacement from the mandrel of a toilet tissue roll holder bearing a service roll thereon, said means comprising a pair of elongated tabs secured along the end surfaces of said rapped roll and extending beyond the peripheral surface thereof, each of said extensions being provided with a hook formed at the free end thereof adapted to be engaged around the mandrel of a toilet tissue roll holder whereby said roll may be suspended below said mandrel and the service roll positioned thereon as a replacement therefore.

United States Patent No. 2008/0169411 A1 to Quinn et al. describes a dispenser for small items has a side wall integral with a bottom panel. A top cover joins the side wall and is rotated between a closed position in contact with the side wall and an open position providing access to the interior. A pair of elongate arms is hinged to the side wall and are rotatable over a range of angles. The arms are configured with a cam segment having a sequence of spurs selectively engagable with the side wall so as to set the arms at a desired angle relative to hold the dispenser in a tilted position to better expose the interior. The arms are hooked so as to grip a roll rod for hanging the dispenser below it.

Notwithstanding the prior art, the present invention is neither taught nor rendered obvious thereby.

SUMMARY OF INVENTION

The present invention is directed to a personal hygiene storage unit that functions both as a hanging storage/dispensing unit and as a personal hygiene travel pack. It includes: (a) a main housing being a support base, the main housing having a hollow body with a bottom, upwardly projecting walls and an open top, the main housing walls including a front wall, a back wall and opposing sidewalls; (b) a back hatch top hingeably connected to the back wall of the main housing and having closing means to fix the back hatch top to the main housing in a closed position; (c) a front hatch top hingeably connected to the front wall of the main housing and having closing means to fix the front hatch top to the main housing in a closed position; and, (d) a pair of opposing elongated hanging hooks connected to at least one of the main housing, the back hatch top and the front hatch top, each of the pair of opposing elongated hooks having a curved distal end adapted for attachment to a toilet paper roll rod and having a proximal end toward the main housing, the proximal end including hinges for folding the hooks to create a compact travel pack and for opening the hooks for hanging.

In some preferred embodiments of the present invention personal hygiene storage unit, the main housing, the back hatch top and the front hatch top are interconnected plural molded plastic components.

In some preferred embodiments of the present invention personal hygiene storage unit, the main housing, the back hatch top and the front hatch top are a single molded plastic component and the back hatch top and the front hatch top are connected to the main body with living hinges.

In some preferred embodiments of the present invention personal hygiene storage unit, the back hatch top includes closing means to permanently attach the back hatch top to the main body in a closed position.

In some preferred embodiments of the present invention personal hygiene storage unit, the front hatch top closing means is a snap-hatch that connects to the back hatch top.

In some preferred embodiments of the present invention personal hygiene storage unit, the hooks are attached to at least one of the main housing and the back hatch top.

In some preferred embodiments of the present invention personal hygiene storage unit, the hooks are attached to at one of the main housing and the back hatch top at locations behind an imaginary top view footprint side-to-side center line to create forward downward tilting of the unit when hung by the hooks to a toilet paper roll rod, to create clearance from a toilet paper roll when closed and when opened, and to create gravity feed dispensing of plural contents.

In some preferred embodiments of the present invention personal hygiene storage unit, the main housing has rounded bottom edges and the front and back hatch tops have rounded top edges.

In some preferred embodiments of the present invention personal hygiene storage unit, the main housing includes at least one integral space divider on its inside bottom.

In some preferred embodiments of the present invention personal hygiene storage unit, the back hatch top closing means is at least one force fit snap lock engageable with the main housing.

In some other preferred embodiments of the present invention personal hygiene storage unit, that functions both as a hanging storage and dispensing unit and as a personal hygiene travel pack, the invention includes: (a) main housing being a support base, the main housing having a hollow body with a bottom, upwardly projecting walls and an open top, the main housing walls including a front wall, a back wall and opposing sidewalls; (b) a back hatch top hingeably connected to the back wall of the main housing and having closing means to fix the back hatch top to the main housing in a closed position; (c) a front hatch top hingeably connected to the front wall of the main housing and having closing means to fix the front hatch top to the main housing in a closed position; and (d) a pair of opposing elongated hanging hooks connected to at least one of the back hatch top and the front hatch top by passing therethrough, and further also connected to the main housing, each of the pair of opposing elongated hooks having a curved distal end adapted for attachment to a toilet paper roll rod and having a proximal end toward the main housing, the proximal end including hinges for folding the hooks to create a compact travel pack and for opening the hooks for hanging. Further, all of the additional features, components, variations and options set forth above may be included in these other embodiments.

Additional features, advantages, and embodiments of the invention may be set forth or apparent from consideration of the following detailed description, drawings, and claims. Moreover, it is to be understood that both the foregoing summary of the invention and the following detailed description are exemplary and intended to provide further explanation without limiting the scope of the invention as claimed.

BRIEF DESCRIPTION OF THE DRAWINGS

The accompanying drawings, which are included to provide a further understanding of the invention and are incorporated in and constitute a part of this specification, illustrate preferred embodiments of the invention and together with the detail description serve to explain the principles of the invention. In the drawings.

DETAILED DESCRIPTION OF THE EMBODIMENTS

Figure 1:
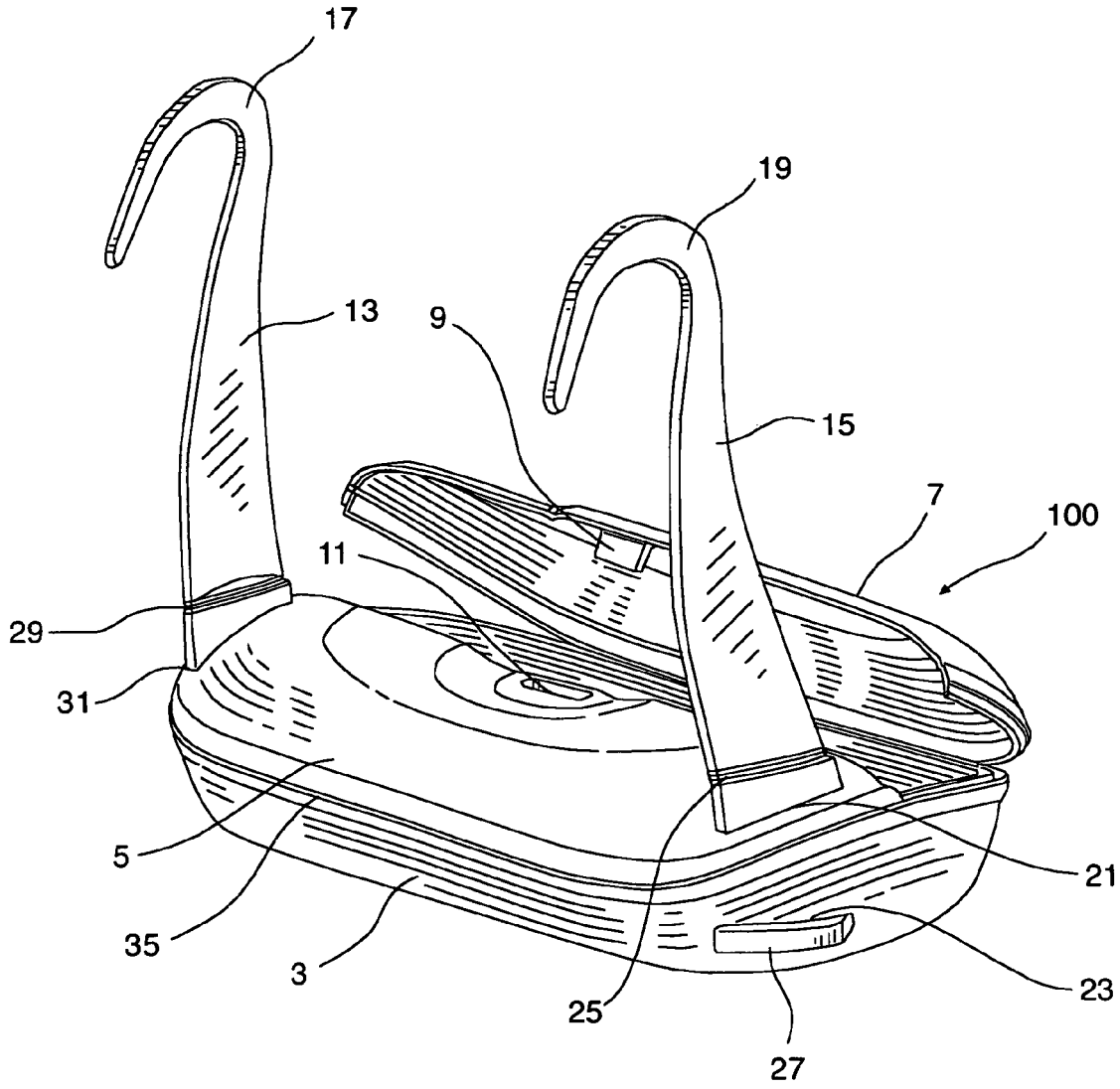
FIG. 1 is an oblique back view of one preferred embodiment present invention personal hygiene storage unit.

Referring now in detail to the drawings wherein like reference numerals designate corresponding parts throughout the several views, various embodiments of the present invention are shown.

FIG. 1 illustrates an oblique back view of one preferred embodiment present invention personal hygiene storage unit 100. It includes a hollowed body main housing that has a bottom 3, with upwardly projecting walls that include a front wall, a back wall and side walls, with rounded corners, as shown. Storage unit 100 has a back hatch top 5 connected to the back wall of bottom 3, and has a front hatch top 7 connected to the front wall of bottom 3. These tops 5 and 7 are connected, in this embodiment, directly to the bottom 3 by living hinges, such as living hinge 35. The back hatch top 5 and the front hatch top 7 are rotatable due to the hinges. However, once back hatch top 5 is closed onto bottom 3, it will force fit and lock onto bottom 3 so that it is no longer moveable relative thereto. (This can alternatively be achieved by heat welding, gluing or any available means.) Front hatch top 7, on the other hand, does not lock in a closed position onto bottom 3 and may repeatedly be opened and closed for storing and accessing personal hygiene items, such as wipes, bandages, medicine, tampons, feminine napkins and the like. Front hatch top 7 has one component of a closing lock, in this case latch male component 9; back hatch top 5 has the other component, in this case latch receiving female component 11. The exact closing latch and positioning is not a critical feature and may be located in any workable configuration. In this case, the back hatch top 5 has the female component and the front hatch top 7 has the male component and is a recessed receiver, but the opposite arrangement would function as well.

When the back hatch top 5 and the front hatch top 7 of the present invention storage unit 100 are closed, they form an imaginary side-to-side centerline. Behind this centerline, on back hatch top 5, are two orifices 21 and 31 for receiving elongated hanging hooks 15 and 13, as shown. Hook 15 has a proximal end 27 that snaps into the main housing at orifice 21 of back hatch top 5 and at orifice 23 of bottom 3. Hook 13 has a proximal end 2 that snaps into the main housing at orifice 31 of back hatch top 5 and at an orifice of bottom 3 (not shown), with more detail given below as to other Figures. Both hooks 15 and 13 have living hinges 25 and 29, respectively, so as to be foldable for compact transport. Because the hooks 13 and 15 are located behind the side-by-side centerline, an intentional feature in preferred embodiments, the unit 100 will tilt downwardly forward when hung, due to the offset center of gravity, and will create both clearance and content gravity feed.

Figure 2:
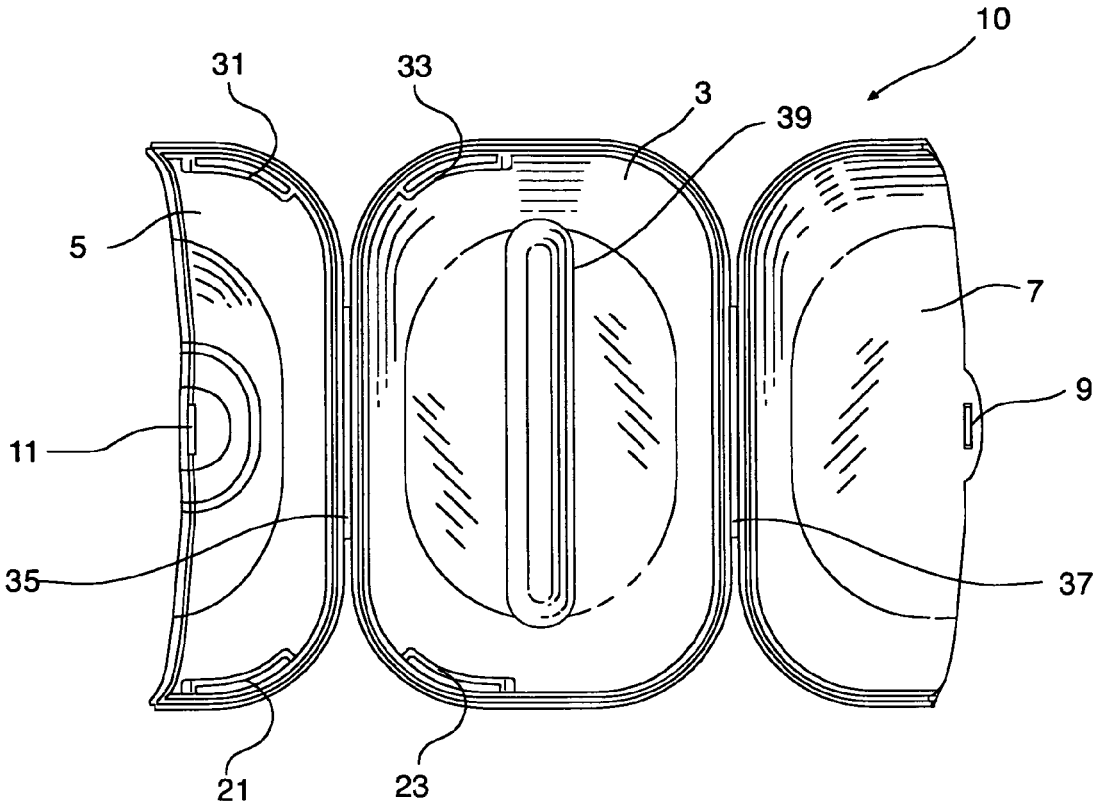
FIG. 2 and FIG. 3 represent open top and side perspective views of the main housing, back hatch top and front hatch top of the present invention personal hygiene storage unit shown in FIG. 1.
Figure 3:
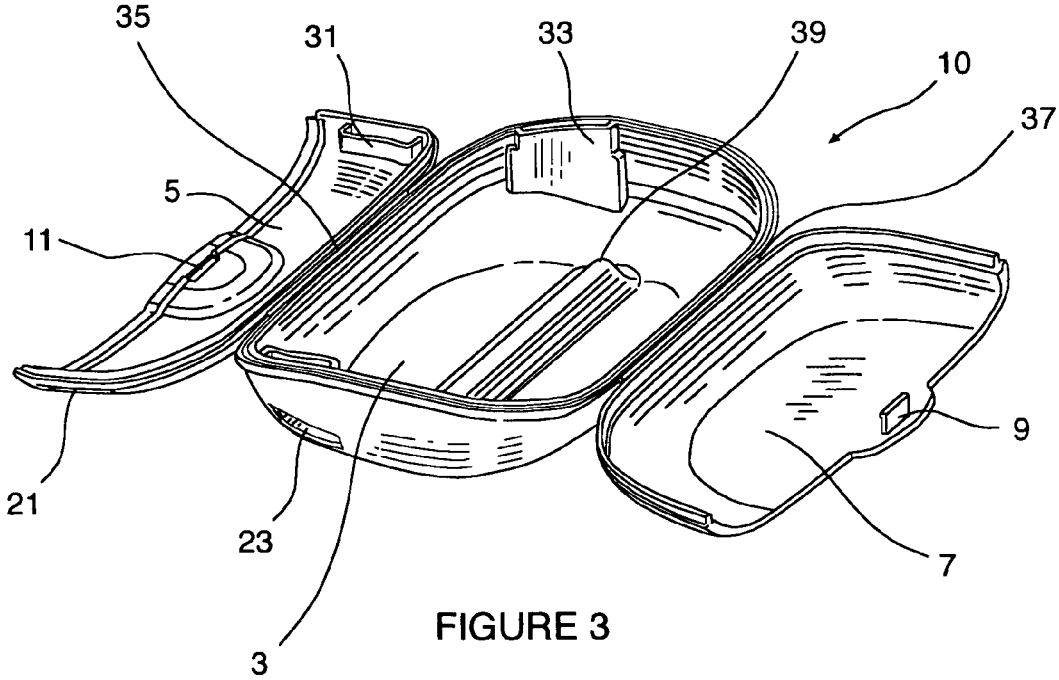

FIG. 2 and FIG. 3 represent open top and side perspective views of the main housing bottom 3, back hatch top 5 and front hatch top 7 (collectively single unitary structure 100, molded as single piece with living hinges 35 and 37) of the present invention personal hygiene storage unit 100 shown in FIG. 1. All components shown in FIG. 1 are identically numbered throughout these drawings and need not be repeated herein or in discussions of Figures below with identically numbered components. As seen in FIGS. 2 and 3, the bottom orifices 23 and 33 are, in this case, extended by the sleeves, as shown. Also, this figure reveals short sleeves for the back hatch top orifices 21 and 31. Further, there is a divider ridge 39 that compartmentalizes the hollow bottom 3 so that items may be separated by user preference, e.g., band aids and tampons.

Figure 4:
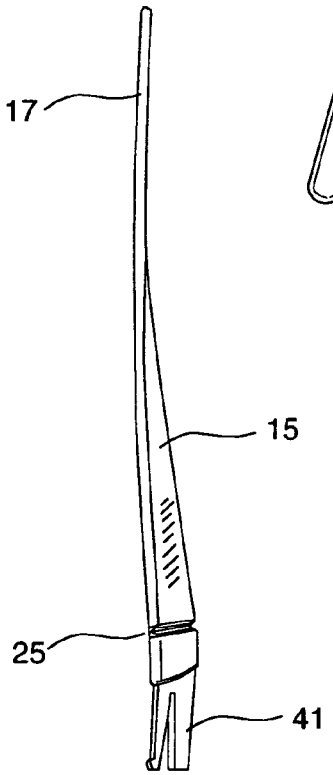
FIGS. 4, 5 and 6 show back, side and front views respectively of an elongated hanging hook of the present invention personal hygiene storage unit shown in FIG. 1.
Figure 5:
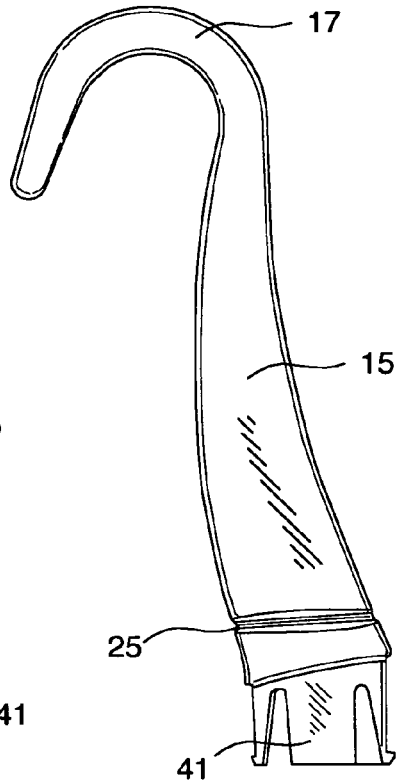
Figure 6:
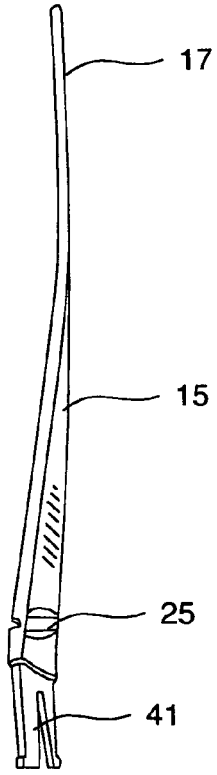

FIGS. 4, 5 and 6 show back, side and front views respectively of an elongated hanging hook 15 of the present invention personal hygiene storage unit 100 shown in FIG. 1. All three figures are discussed simultaneously. Proximal end 41 has spring latches to lock hook 15 into its receiving orifices described above. Living hinge 25 is a thin region that permits the hooks to be folded. Distal end 17 is curved to hook over a rod such as a toilet paper roll rod or a closet rod.

Figure 7:
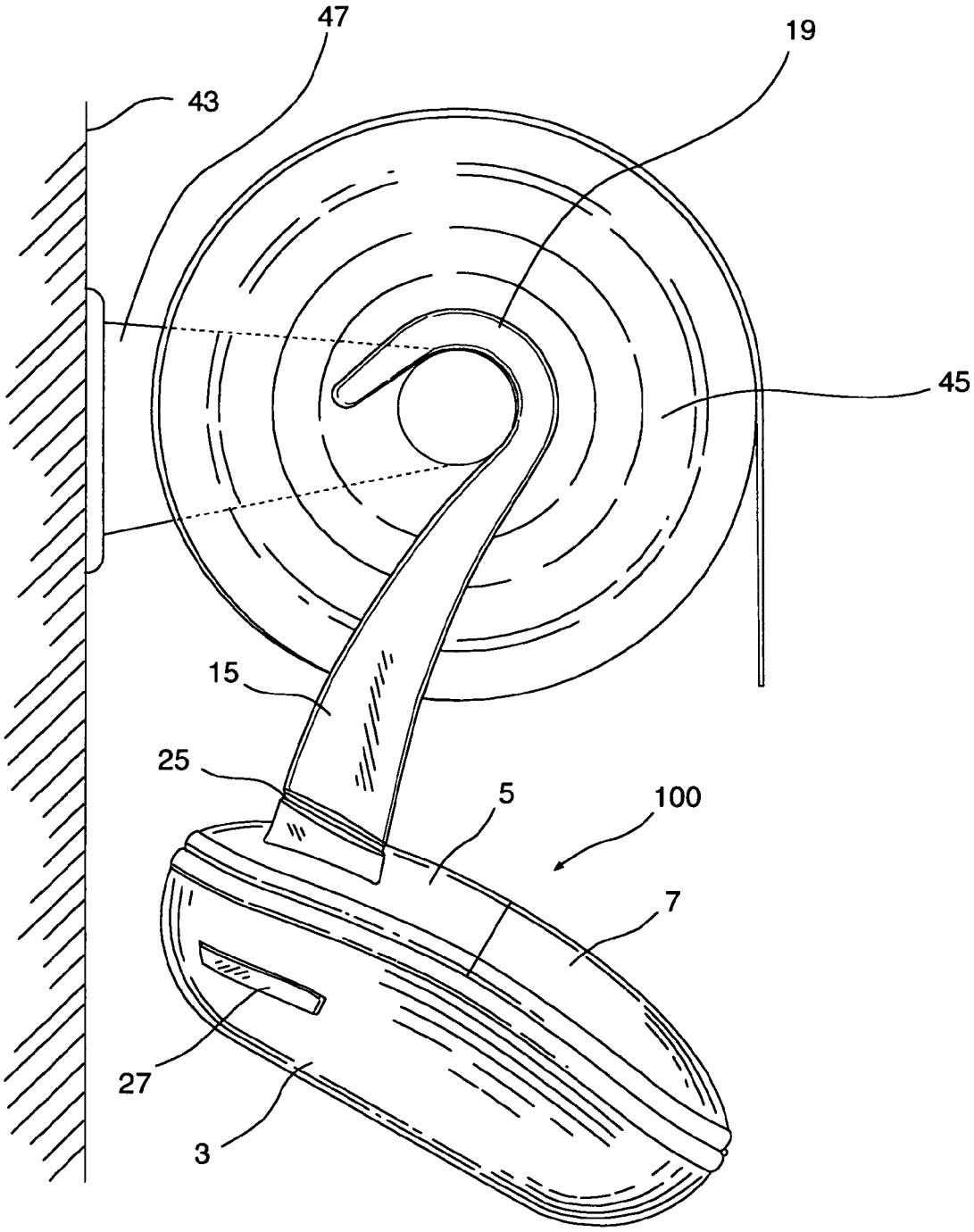
FIG. 7 shows a side view of the present invention storage hygiene unit of FIG. 1 hanging from a toilet paper roll rod.
Figure 8:
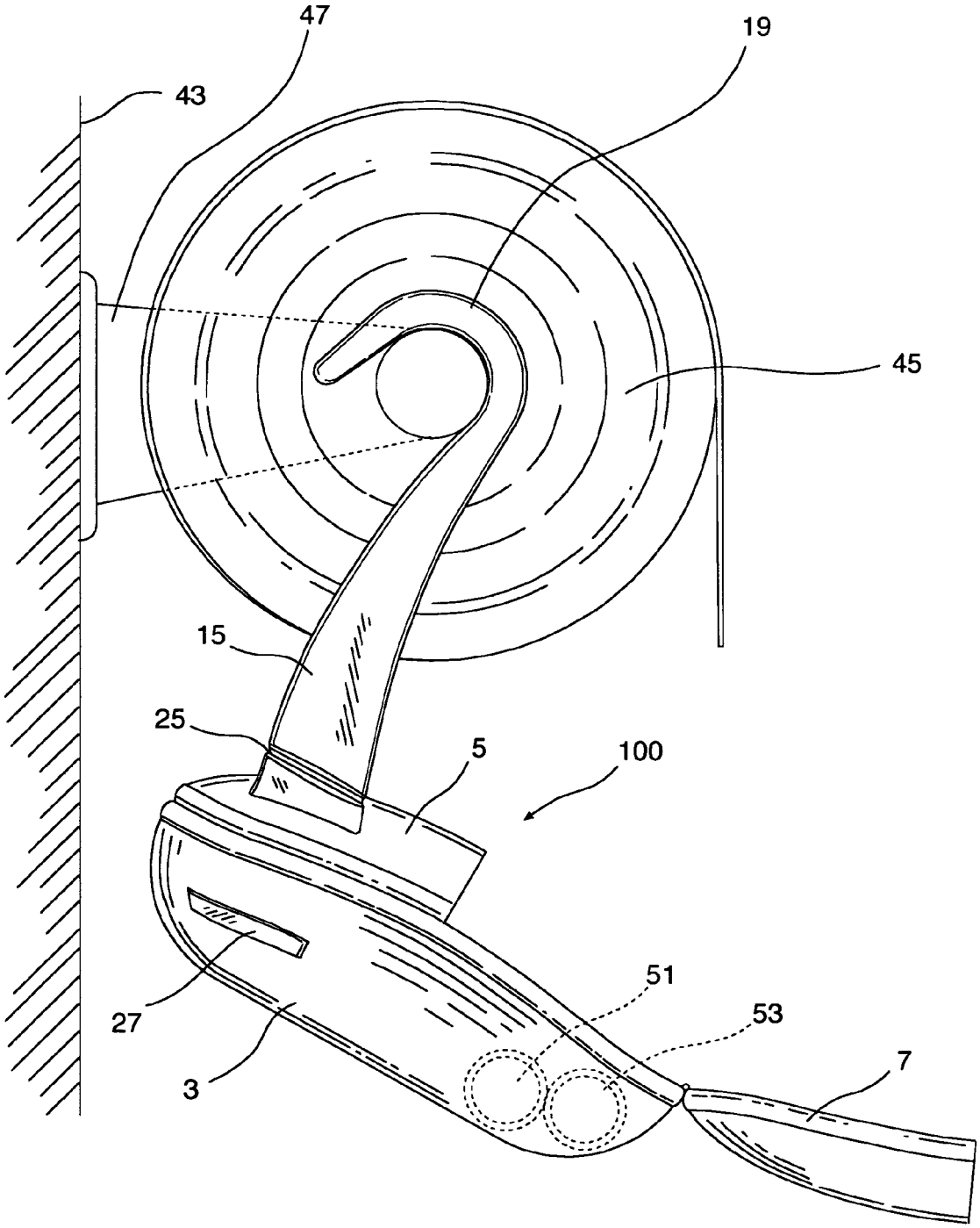
FIG. 8 shows the present invention personal hygiene storage unit of FIG. 7 but opened to provide personal hygiene products for use.

FIG. 7 shows a side view of the present invention storage hygiene unit 100 of FIG. 1 hanging from a toilet paper roll rod of toilet paper roll 45, supported by rod bracket 47, attached to wall 43. In this hanging, tilted, closed configuration, back hatch top 5 is permanently connected to and affixed in the closed position with bottom 3. However, FIG. 8 shows the present invention personal hygiene storage unit 100 of FIG. 7 but opened to provide personal hygiene products for use, e.g., packaged tampons 51 and 53.

Figure 9:
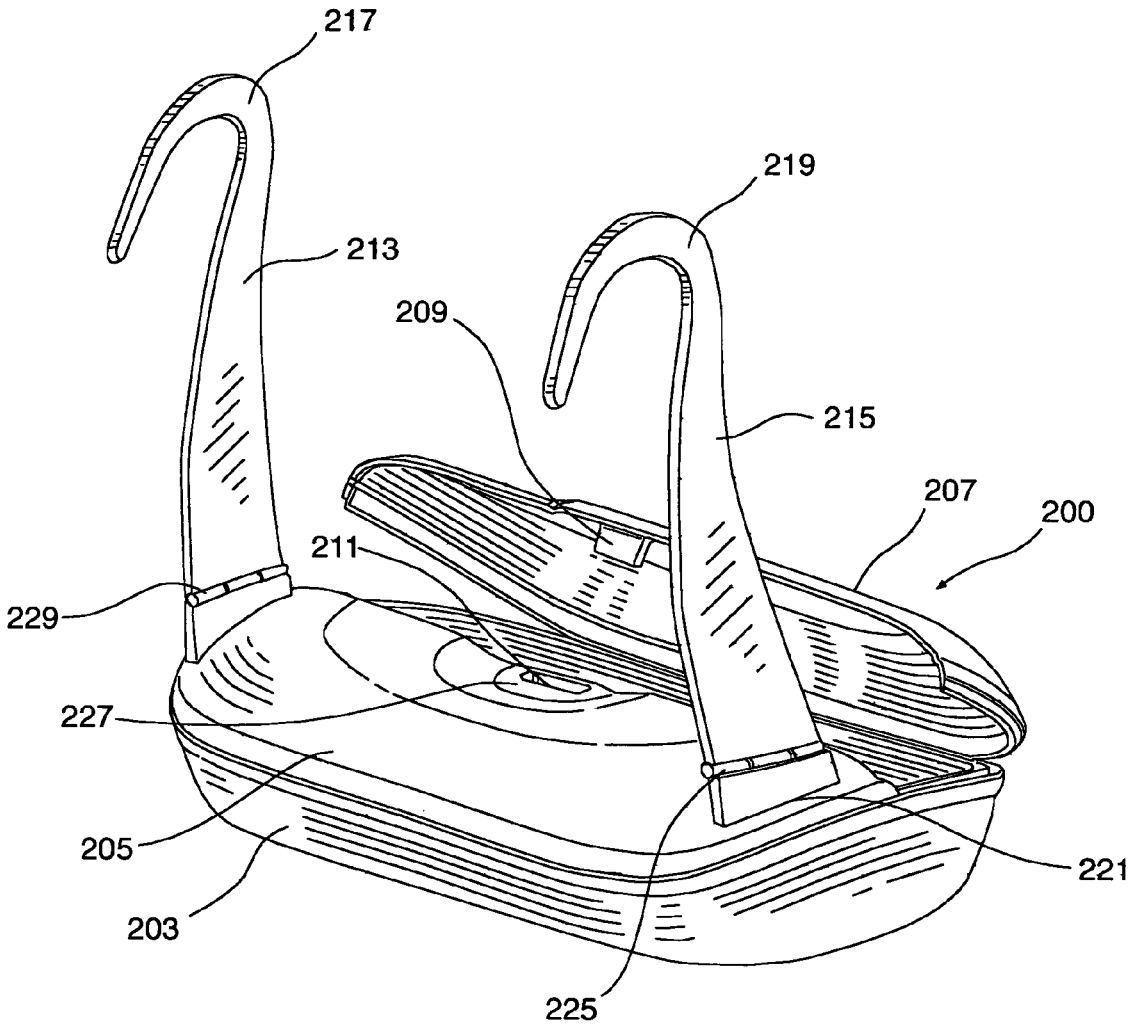
FIG. 9 shows an alternative embodiment of a preferred present invention personal hygiene storage unit; and, FIG. 10 shows another alternative embodiment of a preferred present invention personal hygiene storage unit that is unistructurally formed in a single mold.

FIG. 9 shows an alternative embodiment of a preferred present invention personal hygiene storage unit 200. It includes a hollowed body main housing that has a bottom 203 with upwardly projecting walls that include a front wall, a back wall and side walls and rounded corners; a back hatch top 205; a front hatch top 207; living hinges; latch male component 209 and latch receiving female component 211 with recess 227. In this embodiment, there are no living hinges, but actual rotating hinges 225 and 229. Thus, elongated hanging hooks 213 and 215 are each made from the assemblage of two separate pieces, hingedly connected to one another, so as to be foldable for compact travel use. They have proximal ends (proximal to the main body of the unit) that are heat welded, such as heat weld 221, and have curved distal ends 217 and 219 for hooking onto a rod. This unit 200 may be used in the same manner as unit 100 described in more detail above.

Figure 10:
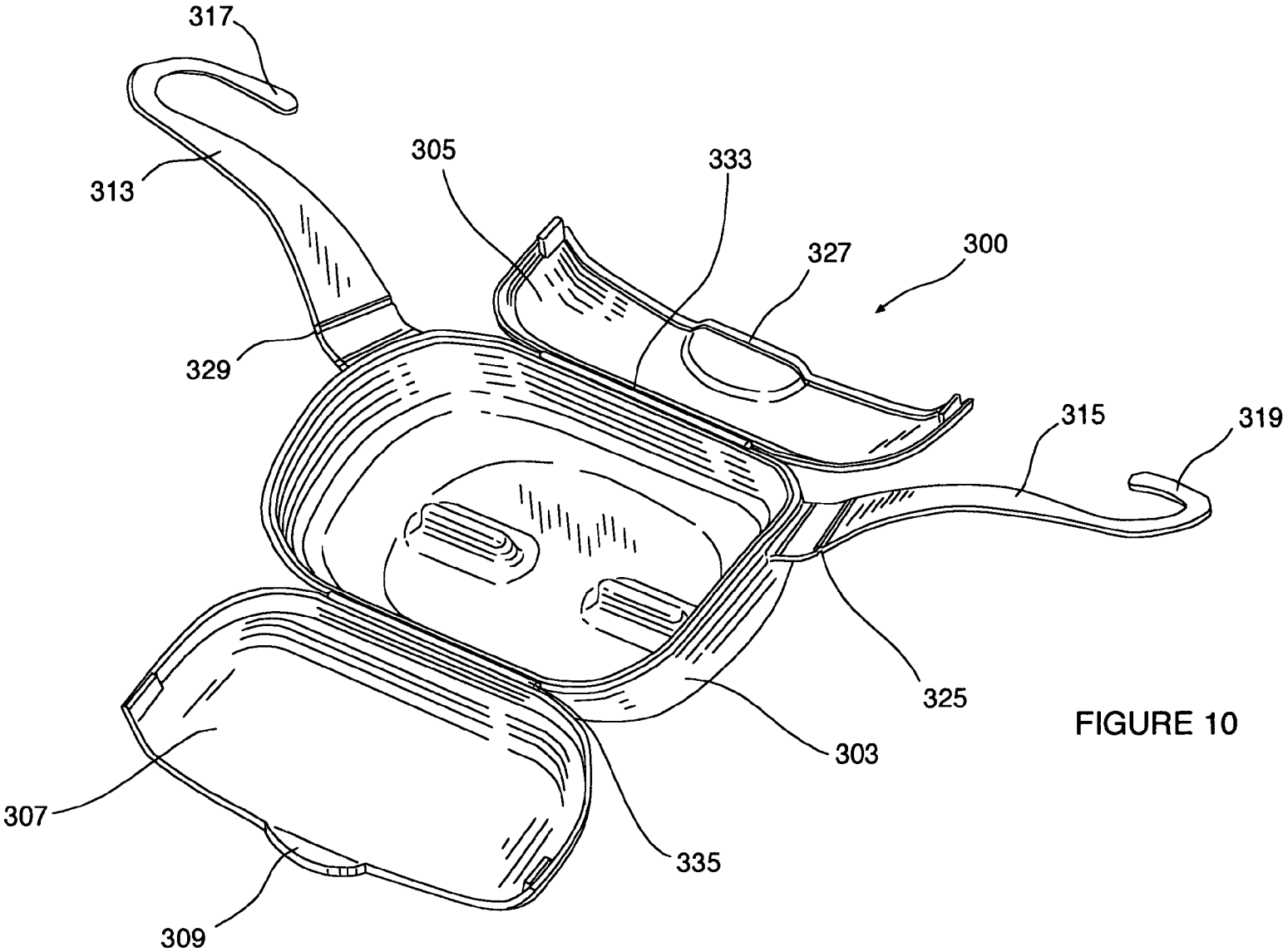

FIG. 10 shows another alternative embodiment of a preferred present invention personal hygiene storage unit 300, wherein the entire product unit is made in a single mold, including the elongated hanging hooks. It includes a hollowed body main housing 303 that has a bottom with upwardly projecting walls that include a front wall, a back wall and side walls and rounded corners; a back hatch top 305; a front hatch top 307; living hinges 333 and 335 that connect the hatch tops to the main body; latch male component 309 and latch receiving female component with recess 327. In this embodiment, the back hatch top 305 has ratchet snaps on each side to permanently close and lock the back hatch top 305 to the main housing 303. The elongated hanging hooks 313 and 315 are each able to be rotated up for use and folded in for storage or for compact travel use. They have curved distal ends 317 and 319 for hooking onto a rod. This unit 300 may be used in the same manner as units 100 and 200 described in more detail above.

Although particular embodiments of the invention have been described in detail herein with reference to the accompanying drawings, it is to be understood that the invention is not limited to those particular embodiments, and that various changes and modifications may be effected therein by one skilled in the art without departing from the scope or spirit of the invention as defined in the appended claims.

What is claimed is:

1. A personal hygiene storage unit that functions both as a hanging storage/dispensing unit and as a personal hygiene travel pack, which comprises:

a) a main housing being a support base, said main housing having a hollow body with a bottom, upwardly projecting walls and an open top, said main housing walls including a front wall, a back wall and opposing sidewalls;

b) a back hatch top hingeably connected to said back wall of said main housing and having closing means to permanently attach said back hatch top to said main body in a closed position;

c) a front hatch top hingeably connected to said front wall of said main housing and having closing means to fix said front hatch top to said main housing in a closed position; and, d) a pair of opposing elongated hanging hooks connected to at least one of said main housing, said back hatch top and said front hatch top, each of said pair of opposing elongated hooks having a curved distal end adapted for attachment to a toilet paper roll rod and having a proximal end toward said main housing, said proximal end including hinges for folding said hooks to create a compact travel pack and for opening said hooks for hanging.

2. The personal hygiene storage unit of claim 1 wherein said main housing, said back hatch top and said front hatch top are interconnected plural molded plastic components.

3. The personal hygiene storage unit of claim 1 wherein said main housing, said back hatch top and said front hatch top are a single molded plastic component and said back hatch top and said front hatch top are connected to said main body with living hinges.

4. The personal hygiene storage unit of claim 1 said hollow bottom includes a divider ridge to compartmentalize said hollow bottom.

5. The personal hygiene storage unit of claim 1 wherein said front hatch top closing means is a snap-hatch that connects to said back hatch top.

6. The personal hygiene storage unit of claim 1 wherein said hooks are attached to at least one of said main housing and said back hatch top.

7. The personal hygiene storage unit of claim 6 wherein said hooks are attached to at one of said main housing and said back hatch top at locations behind an imaginary top view footprint side-to-side center line to create forward downward tilting of said unit when hung by said hooks, to create clearance from a toilet paper roll and to create gravity feed dispensing of plural contents.

8. The personal hygiene storage unit of claim 1 wherein main housing has rounded bottom edges and said front and back hatch tops have rounded top edges.

9. The personal hygiene storage unit of claim 1 wherein said main housing includes at least one integral space divider on its inside bottom.

10. The personal hygiene storage unit of claim 1 wherein said back hatch top closing means is at least one force fix snap lock engageable with said main housing.

11. A personal hygiene storage unit that functions both as a hanging storage and dispensing unit and as a personal hygiene travel pack, which comprises:

a) a main housing being a support base, said main housing having a hollow body with a bottom, upwardly projecting walls and an open top, said main housing walls including a front wall, a back wall and opposing sidewalls;

b) a back hatch top hingeably connected to said back wall of said main housing and having closing means to permanently attach said back hatch top to said main body in a closed position;

c) a front hatch top hingeably connected to said front wall of said main housing and having closing means to fix said front hatch top to said main housing in a closed position; and, d) a pair of opposing elongated hanging hooks connected to at least one of said back hatch top and said front hatch top by passing there through, and further also connected to said main housing, each of said pair of opposing elongated hooks having a curved distal end adapted for attachment to a toilet paper roll rod and having a proximal end toward said main housing, said proximal end including hinges for folding said hooks to create a compact travel pack and for opening said hooks for hanging.

12. The personal hygiene storage unit of claim 11 wherein said main housing, said back hatch top and said front hatch top are interconnected plural molded plastic components.

13. The personal hygiene storage unit of claim 11 wherein said main housing, said back hatch top and said front hatch top are a single molded plastic component and said back hatch top and said front hatch top are connected to said main body with living hinges.

14. The personal hygiene storage unit of claim 11 said hollow bottom includes a divider ridge to compartmentalize said hollow bottom.

15. The personal hygiene storage unit of claim 11 wherein said front hatch top closing means is a snap-hatch that connects to said back hatch top.

16. The personal hygiene storage unit of claim 11 wherein said each of said back hatch top and said main housing have two hook proximal end-receiving orifices, and said hooks are attached to both of said main housing and said back hatch top via said orifices.

17. The personal hygiene storage unit of claim 16 wherein said hooks are attached to at one of said main housing and said back hatch top at locations behind an imaginary top footprint view side-to-side center line to create forward downward tilting of said unit when hung by said hooks, to create clearance from a toilet paper roll and to create gravity feed dispensing of plural contents.

18. The personal hygiene storage unit of claim 11 wherein main housing has rounded bottom edges and said front and back hatch tops have rounded top edges.

19. The personal hygiene storage unit of claim 11 wherein said main housing includes at least one integral space divider on its inside bottom.

20. The personal hygiene storage unit of claim 11 wherein said back hatch top closing means is at least one force fix snap lock engageable with said main housing.

* * * * *